US006626240B1

(12) United States Patent
Sunde

(10) Patent No.: US 6,626,240 B1
(45) Date of Patent: Sep. 30, 2003

(54) DEVICE FOR ANNULAR WELL ISOLATION

(75) Inventor: Egil Sunde, Sandnes (NO)

(73) Assignee: Den Norske Stats Oljeselskap A.S., Stavanger (NO)

( * ) Notice: Subject to any disclaimer, the term of this patent is extended or adjusted under 35 U.S.C. 154(b) by 0 days.

(21) Appl. No.: 09/913,580

(22) PCT Filed: Feb. 8, 2000

(86) PCT No.: PCT/NO00/00044

§ 371 (c)(1),
(2), (4) Date: Aug. 16, 2001

(87) PCT Pub. No.: WO00/49270

PCT Pub. Date: Aug. 24, 2000

(30) Foreign Application Priority Data

Feb. 19, 1999 (NO) ..... 19990781

(51) Int. Cl.[7] ..... E21B 33/136
(52) U.S. Cl. ..... 166/196; 166/207; 166/316
(58) Field of Search ..... 166/207, 196, 166/316, 118, 120, 189, 203, 136, 212, 214

(56) References Cited

U.S. PATENT DOCUMENTS

| | | | | |
|---|---|---|---|---|
| 1,647,630 A | | 11/1927 | Hyer | |
| 3,670,815 A | * | 6/1972 | Brown | 166/136 |
| 3,955,625 A | | 5/1976 | Hughes et al. | |
| 4,548,265 A | | 10/1985 | Luke | |
| 5,533,570 A | | 7/1996 | Streich et al. | |
| 5,775,429 A | * | 7/1998 | Arizmendi et al. | 166/387 |
| 6,234,249 B1 | * | 5/2001 | Andersen et al. | 166/118 |

FOREIGN PATENT DOCUMENTS

GB 1 294 721 11/1972

* cited by examiner

*Primary Examiner*—David Bagnell
*Assistant Examiner*—Giovanna M. Collins
(74) *Attorney, Agent, or Firm*—Foley & Lardner

(57) ABSTRACT

Device for annular isolation in oil/gas wells comprising a production tube, the production tube comprises coaxially positioned, cylindrical sleeve (5) having in one end an at least partially radially directed opening slot (2), said sleeve including a cylindric sealing crown (1) coupled in one end to a release mechanism (3, 4) adapted to push the sealing crown (1) out through the opening, said sealing crown (1) in its other end being expandable in the tangential direction.

13 Claims, 10 Drawing Sheets

DEVICE FOR ANNULAR WELL ISOLATION

CROSS-REFERENCE TO RELATED APPLICATIONS

This application is the U.S. national stage of Patent Cooperation Treaty application number PCT/NO 00/00044 filed Feb. 8, 2000, and claims the benefit of priority to Norwegian application 19990781, filed Feb. 19, 1999.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISK

Not Applicable.

BACKGROUND OF THE INVENTION

This invention relates to a device for annular isolation in an oil/gas well comprising a casing.

Zone isolation in oil production is especially important in horizontal open hole wells in which the well penetrates a number of formations, which may require simultaneously controlling sand using screens. In controlling water or gas migrations in these formations it is important for maximizing the well's potential and lifetime to secure annular isolation in these zones. This has been done using so-called ECP's (External Casing Packers) in which, after packing elements have been positioned in the well, a tool is lowered which inflates a rubber bellows with concrete. This operation has been performed in a number of wells with variable results.

In the patent publications U.S. Pat. No. 3,581,816 and NO 172.554, inflatable packers are described for positioning in casings and sealing at a chosen position in the well. In practice these solutions have not functioned satisfactory.

BRIEF SUMMARY OF THE INVENTION

It is an object of this invention to provide a device for annular isolation in wells which may be mounted integral with the wells casing, and which may be activated at a chosen position in the well to hinder movement of gas or liquids along the well.

Several solutions have been suggested for sealing or anchoring of packer devices in casings or similar, as is shown in the following patent publications: GB 1.245.383, GB 2.074.635, U.S. Pat. No. 3,561,529, U.S. Pat. No. 4,548,265 and U.S. Pat. No. 4,554,973. However, none of these solutions are] suitable for use in long horizontal sections. Also, these solutions have limitations in the available amount of expansion, which follows from the fact that they are adapted to be used in casings having known dimensions. A device for obtaining annular isolation in a well also has to provide sealing against the formation the cases in which the well is oval or has other deviations from a circular cross section.

It is thus an object of the present invention to provide a device for annular well isolation able to make a seal against the formation in a well when the well has a non-circular cross section.

To obtain these objects, a device as described above is, according the invention, provided which in the production pipe comprises a coaxially positioned cylindrical sealing crown coupled to a release mechanism adapted to push the sealing crown out through the opening, the sealing crown being expandable in the tangential direction.

In this way, an annular packer is obtained which may be integrated in a chosen position in a casing during installation, and which may be activated using available tools to engage the surrounding formations with varying quality and with varying cross sections. The installed packer constitutes a part of the casing and, thus does not hinder the normal use of the well.

BRIEF DESCRIPTION OF THE SEVERAL VIEWS OF THE DRAWINGS

The intention will be described below with reference to the drawings, which show examples of possible embodiments of the invention.

DETAILED DESCRIPTION OF THE INVENTION

Figure 1:
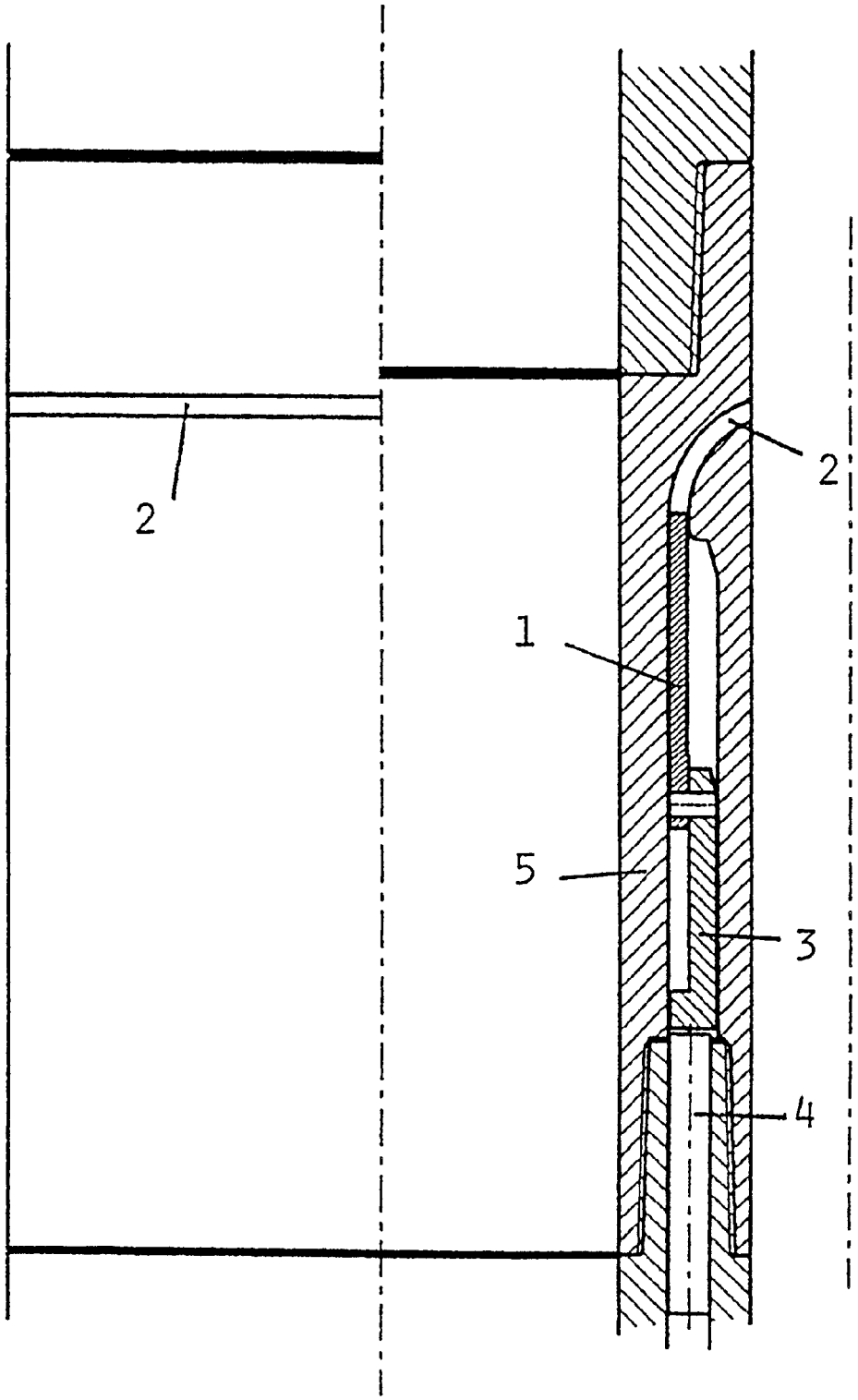
FIG. 1 shows a partial longitudinal section of a device according to the invention before being activated.

FIG. 1 shows a device according to the invention in which a cylindrical sealing crown 1 is positioned in a channel in a sleeve 5 in the pipe. In the embodiment shown in this figure, the channel stretches the whole circumference of the pipe and is in its one end deflected in the radial direction making a slot shaped opening 2 through which the sealing crown 1 may be pushed. The sealing crown 1 is fastened to a release mechanism 3, 4 adapted to push the sealing crown 1 out through the slot 2. The slot deflects the sealing crown 1 from an axial direction in a radial direction, at least partially, so as to be pushed out of the pipe and toward the surrounding formation.

Figure 10:
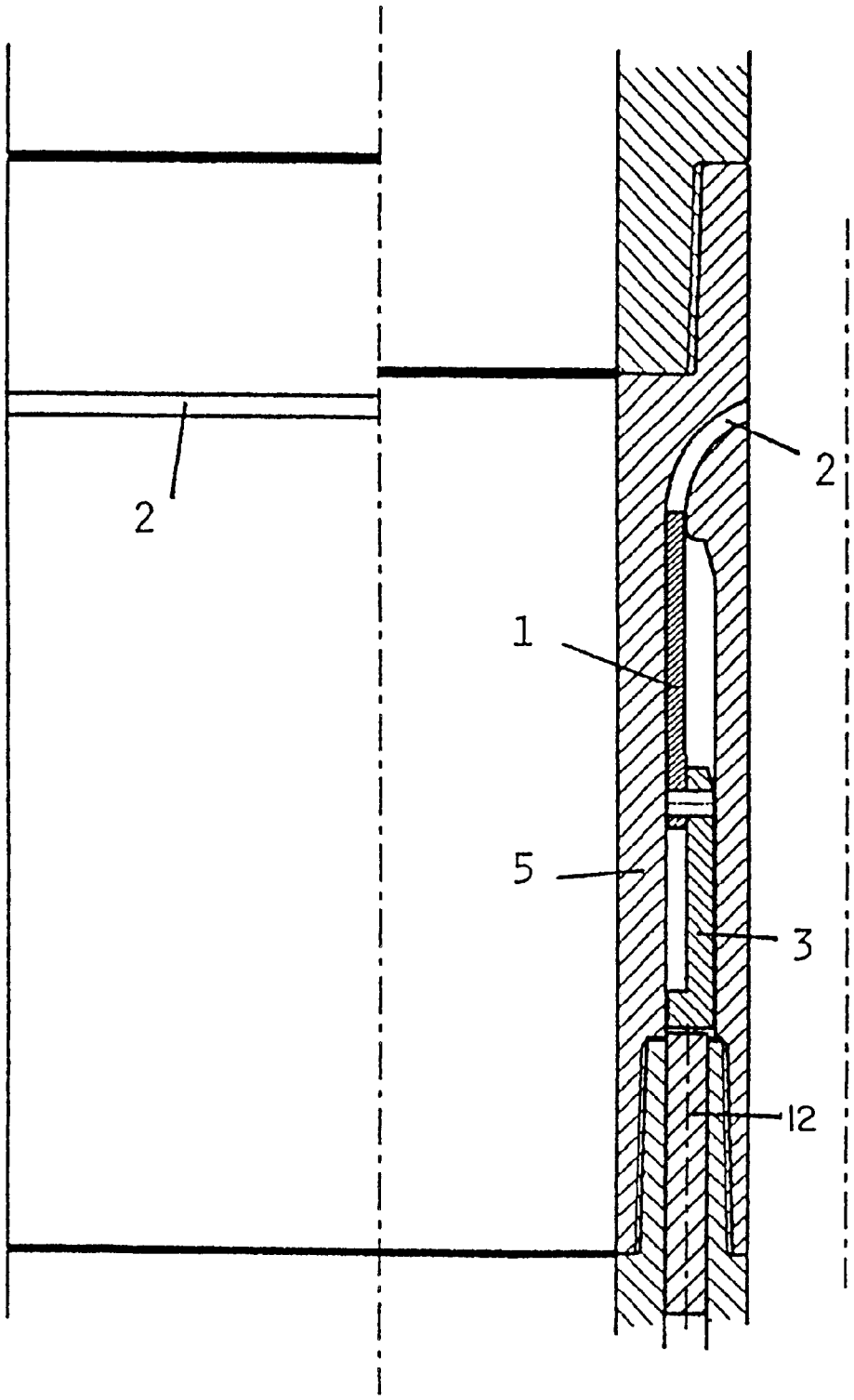
FIG. 10 shows a partial longitudinal section of a device according to another embodiment of the invention.

The release mechanism consists, as shown in the drawing, of a holding part 3 and a pushing part 4, which may be one or more hydraulic pistons 4 positioned around the circumference of the pipe. In an alternative embodiment, the pushing part may be one or more preloaded springs 12 as shown in FIG. 10.

In the figure, the sealing crown 1 is positioned inside the slot. This position is, of course, optional, but the ends of the sealing crown 1 should not protrude outside the slot opening.

The device according to the invention is illustrated in the drawing as an integral part of the pipe, without presenting any changes in the inner or outer diameter of the pipe, which is usually the case in the known solutions.

The pushing parts 4, may be activated in a known way, e.g. by pressurizing the well so that an obstruction is broken and the mechanism released. Another alternative is to provide the device according to the invention with coupling devices accessible to setting tools, which in a known way, may be introduced into the well in order to release the pushing parts 4. If means for signal or energy transmission from the surface are available, they may also be used to activate the pushing parts 4.

Figure 2:
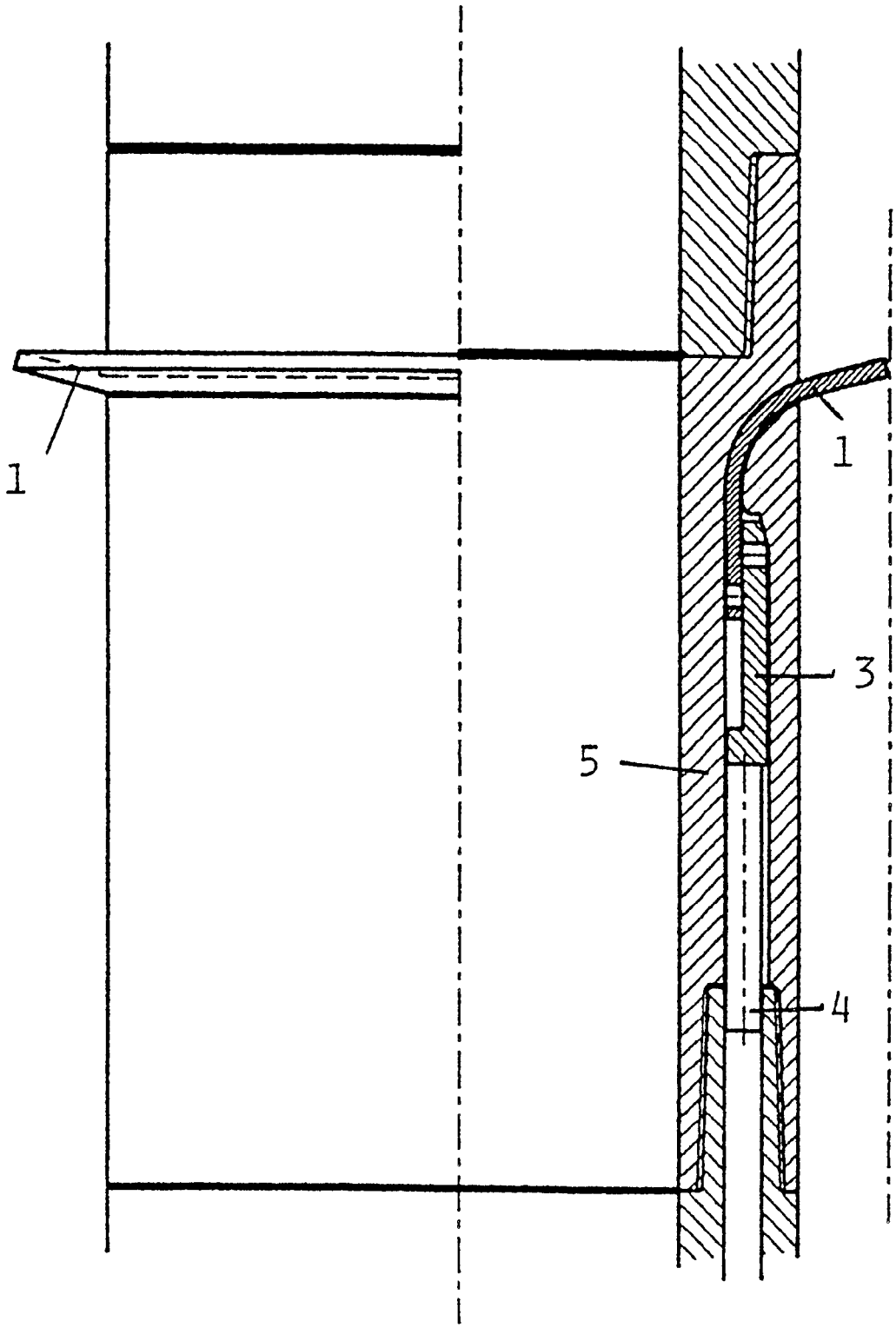
FIG. 2 shows a partial longitudinal section of the device in FIG. 1 after being activated.
Figure 3:
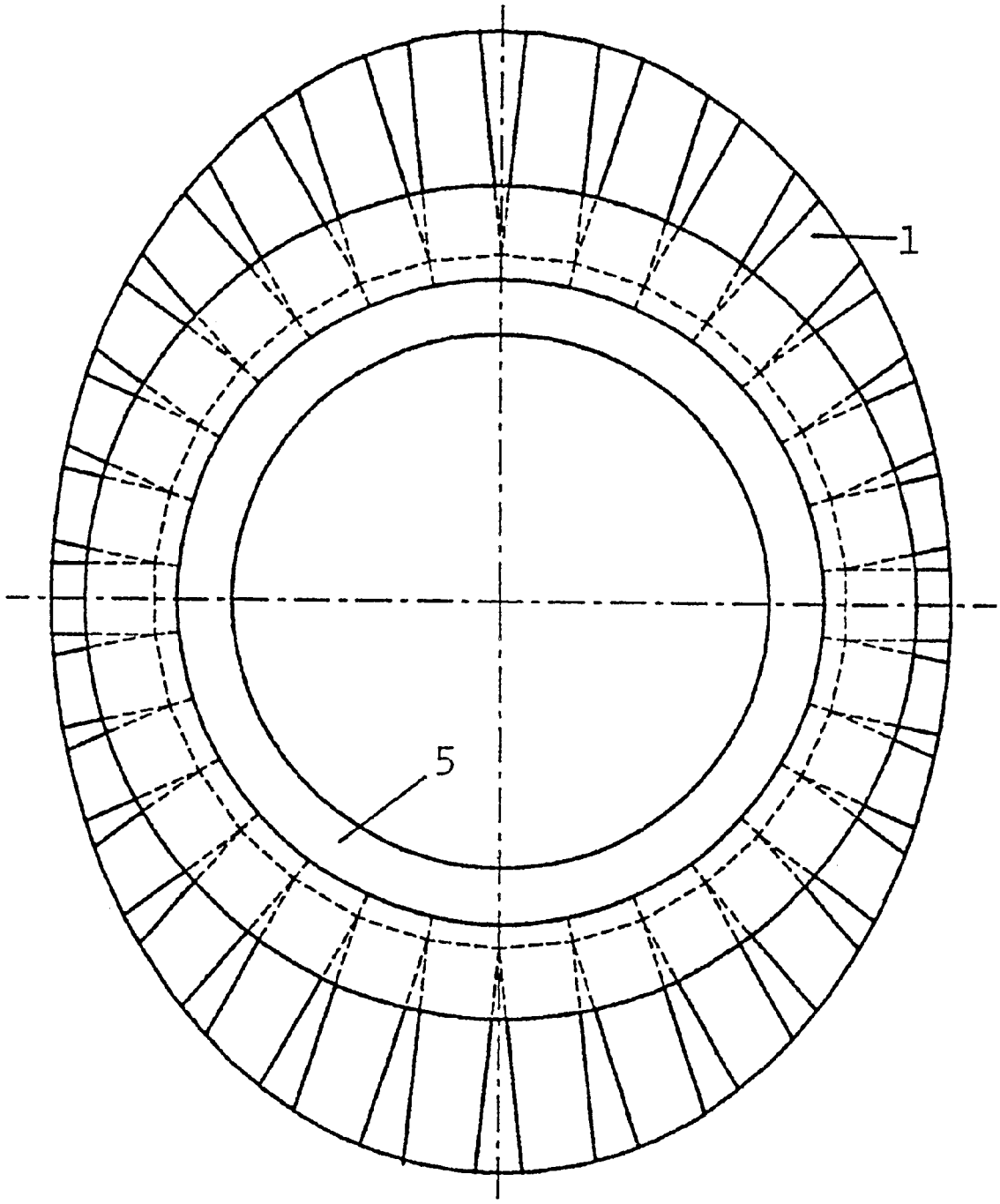
FIG. 3 shows a device according to the invention after being activated in a well with an oval cross section, as seen along the axial direction of the well.

In FIG. 2 the device is shown after the sealing crown 1 has been forced out through the slot 2 by the hydraulic piston 4, while FIG. 3 illustrates how this will look in an axial projection.

Figure 4B:
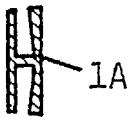
FIGS. 4B and 4C illustrate details of a portion of the structure shown in FIG. 4A.
Figure 4C:
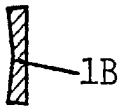
Figure 4A:
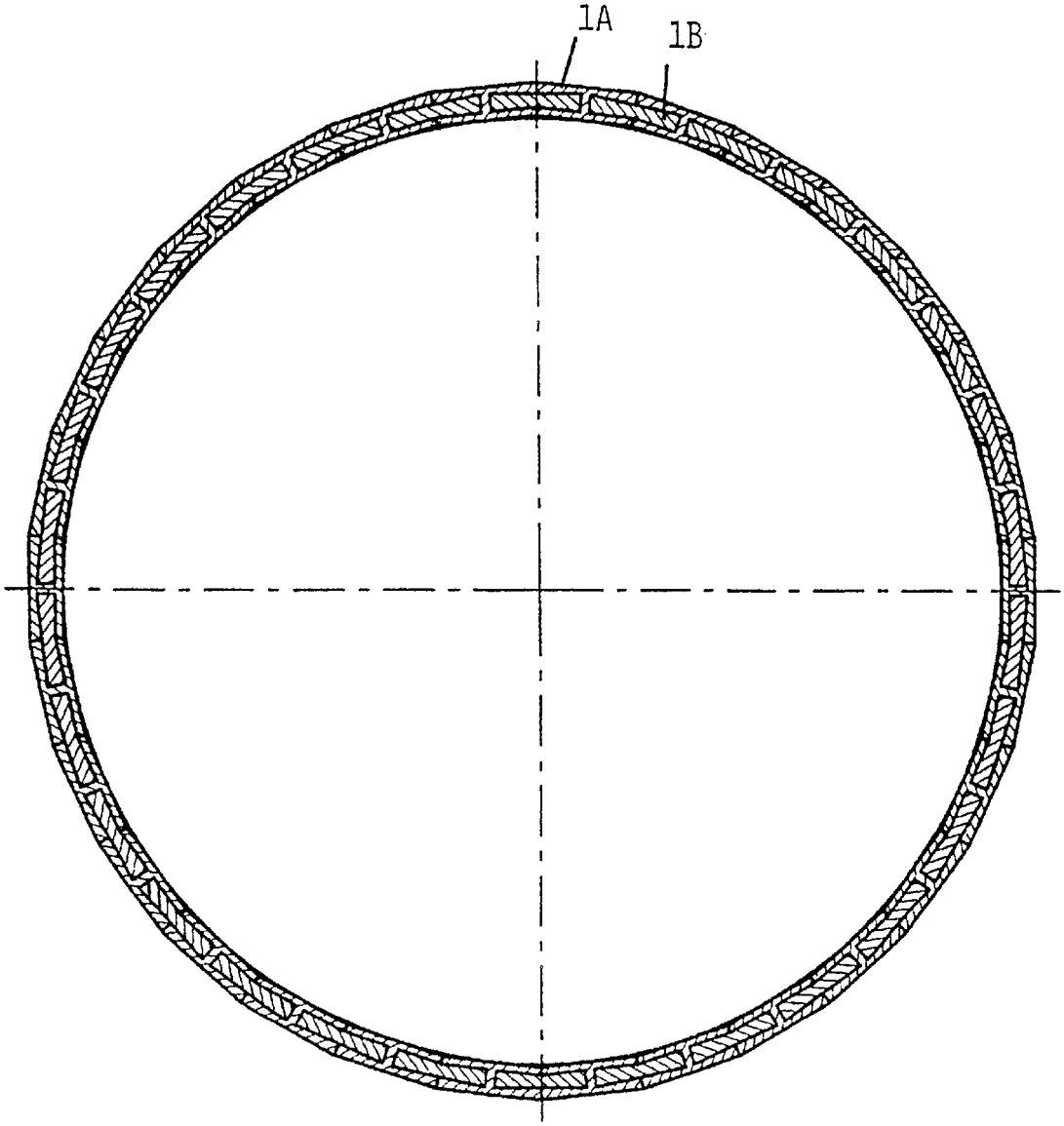
FIG. 4A illustrates an embodiment of the ribs in a device according to the invention.

As is evident from the drawings the sealing crown is expandable in the tangential direction, since the circumference increases as it is forced outwards. In addition the sealing crown is capable of being forced to different lengths depending on the distance to the well wall in the different directions. FIG. 4 illustrates an example showing a sealing crown consisting of a number of ribs, 1A, 1B engaging into each other in such a way that they may move sideways relative to each other, so as to increase the total circumference of the sealing crown. One of the ribs, 1A has an H-shaped cross section so as to accept one side of the second, plane rib in the space between the upper and the lower parts of the rib. This way, the second rib may be pulled sideways more or less out of the openings in the first rib, so that the circumference is increased without producing openings between the ribs.

The ribs may be made from a number of materials, but are preferably made from a metal, and may be provided with a rubber or similar coating to obtain good sealing between them. The ribs may also be provided with a soft material, e.g. lead or rubber, on their outer ends to obtain good grip and sealing against the formation.

According to another embodiment of the invention, the slot opening 2 may be provided with an inserted rubber ring (not shown) of a very flexible type adapted to cover the outer ends of the sealing crown and provide a seal against the surrounding formation. The rubber ring is preferably positioned in an expansion in the outmost part of the slot opening 2. In this embodiment, the sealing crown is positioned with its outer end in contact with the rubber ring, close to the slot opening.

Figure 5:
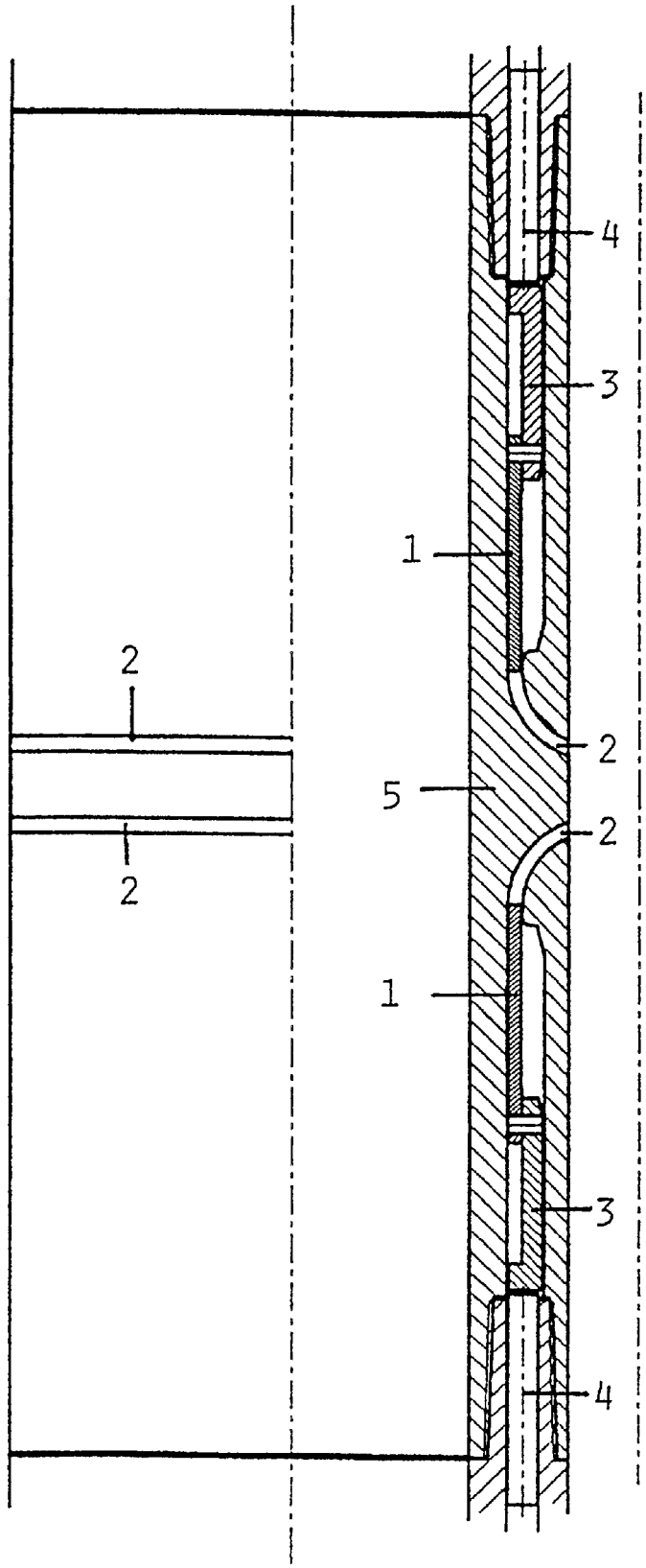
FIG. 5 shows, similar to FIG. 1, two devices according to the invention oriented toward each other, before being activated.
Figure 6:
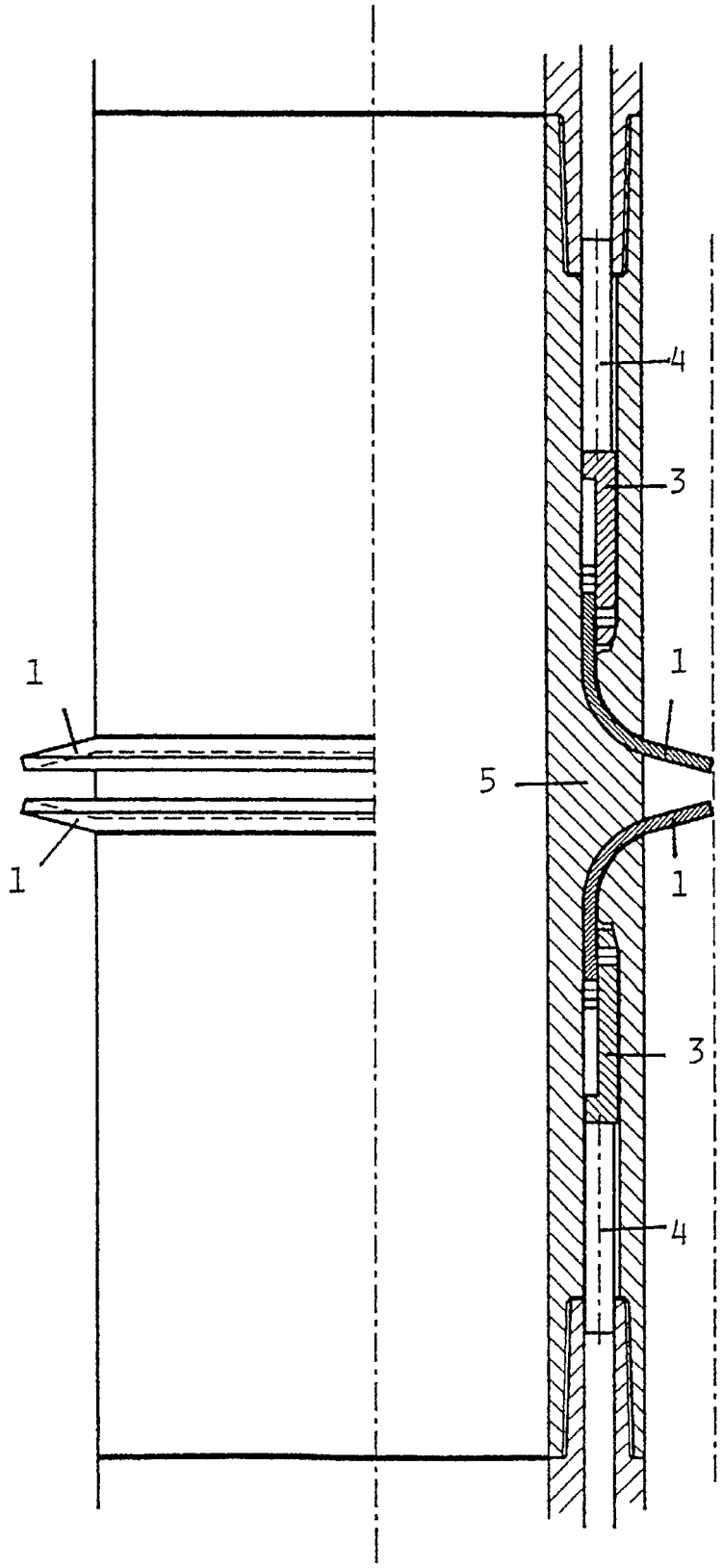
FIG. 6 shows similarly the device shown in FIG. 5 after being activated.

FIG. 5 shows a similar configuration as that in FIG. 1, showing the use of two sealing crowns, and FIG. 6 shows in the same way as FIG. 2 the situation when the sealing crowns 1 are forced out through the slots. The use of two sealing crowns 1 may provide advantages when they may be subject to pressure from both sides. Because of the angle against the formation the lower sealing device may be forced toward the pipe if pressure arises below the casing device, but the upper sealing device will, in this situation, be pressed into improved contact with the formation so that the seal will be maintained.

Figure 7B:
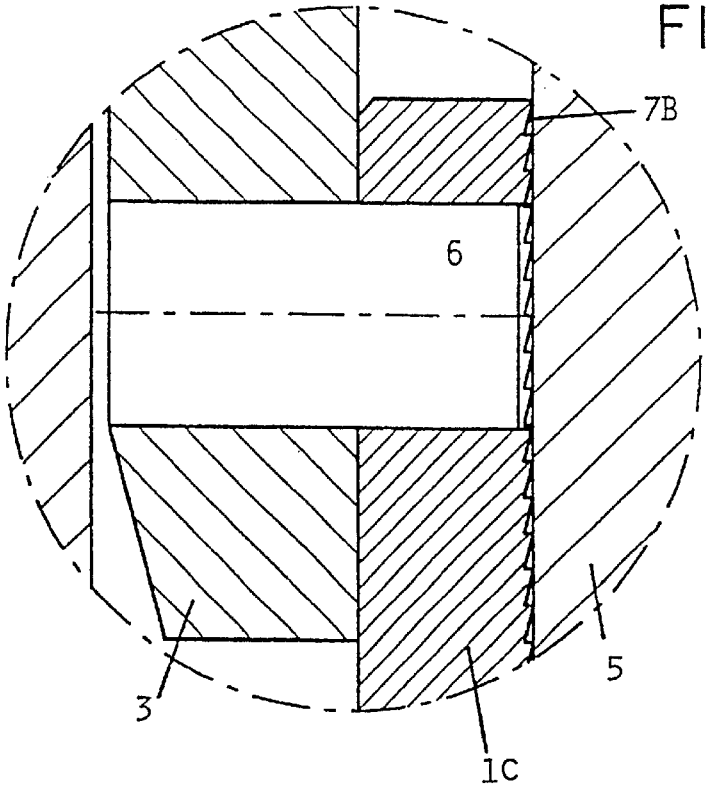
FIG. 7B shows a detail of the device shown in FIG. 7A.
Figure 7A:
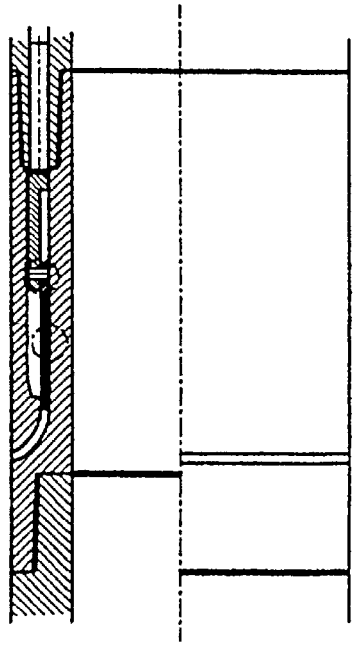
FIG. 7A illustrates the device according to the invention with sections highlighted.
Figure 7C:
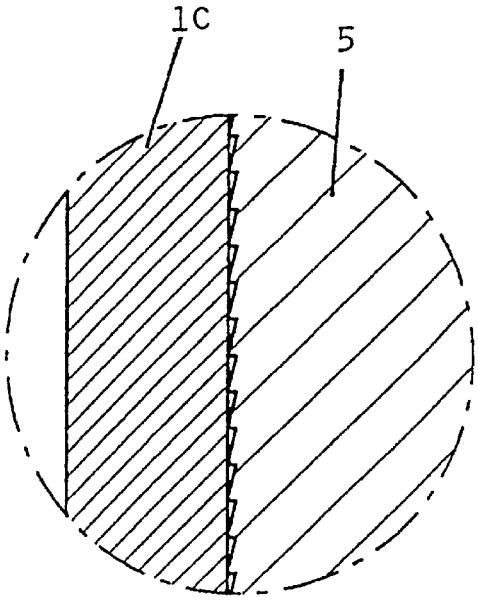
FIG. 7C shows a detail of the device shown in FIG. 7A.
Figure 8A:
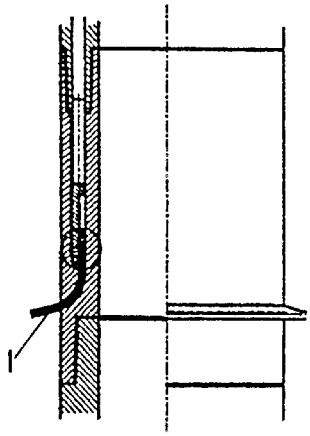
FIG. 8A illustrates the device after being activated, with the ribs locked in position.
Figure 8B:
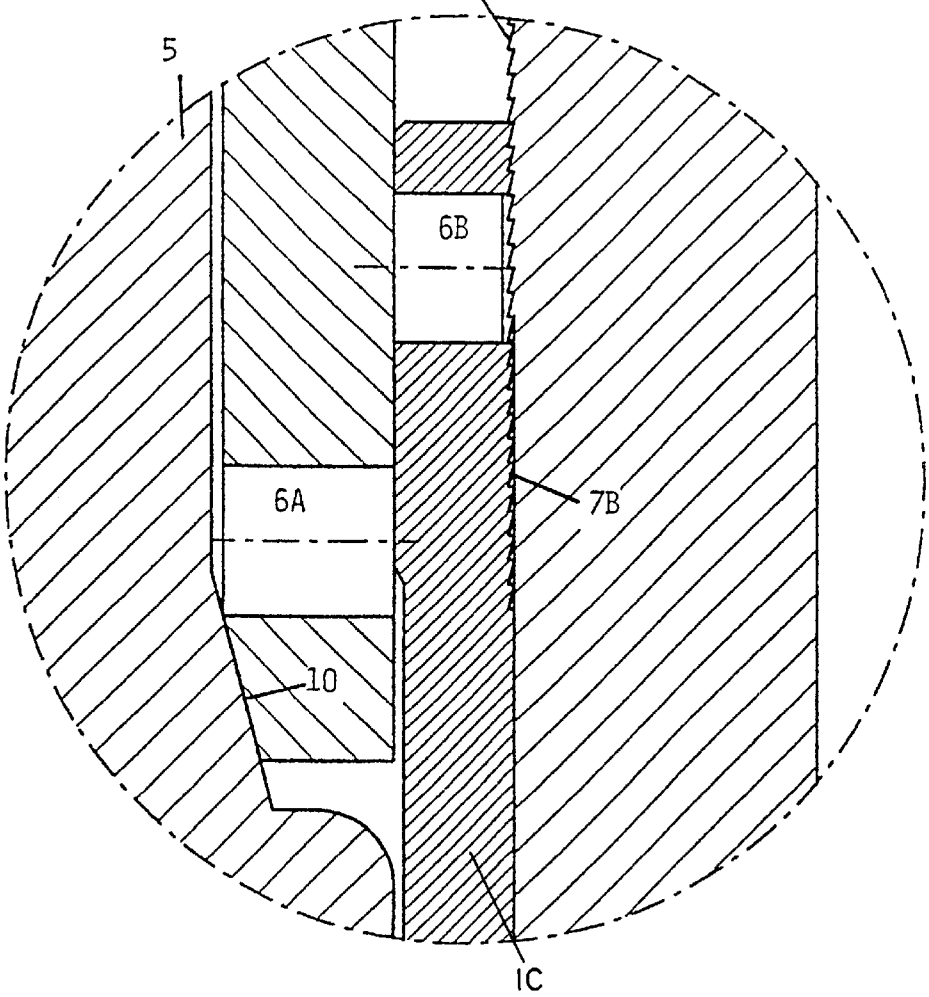
FIG. 8B shows a detail of the device shown in FIG. 8A.

As mentioned above, it is an important advantage of the present invention that the sealing crown is able to seal against non-circular wells. With the present embodiments this means that the sealing crown 1 comprises a number of ribs 1C that must be capable of being pushed out through the slot to different lengths. To make this possible, each of the ribs 1C, according to a preferred embodiment of the invention, is fastened to holding part 3, e.g. by means of a breakable bolt 6. When each rib 1C reaches the formation wall, the pressure from the pushing part 4 and the holding part 3 will break the bolt, so that the holding part 4 is able to continue movement after the rib 1C has stopped. Preferably, the holding part 4 and/or the rib 1C is wedge shaped along at least a part of its length 10, so that the further movement of the holding part presses the rib 1C against the pipe material. According to an embodiment of the invention, both the rib 1C and the pipe material comprise grooves, barbs or similar 7A, 7B locking the rib into position. FIGS. 7A, 7B and 7C shows the bolt 6 and the grooves 7A, 7B before the bolt has broken, while FIGS. 8A and 8B shows the structure after the bolt 6A, 6B has broken and the grooves 7A, 7B are pressed against each other, so that the rib 1C is locked into position. The grooves may be located between the ribs and the pipeline 5, between the holding parts 3 and the ribs 1C and/or between the holding part 3 and the pipe 5.

As the holding part 3 in this embodiment is pushed a predetermined length, the holding part may consist of a cylindrical ring being fastened to each of the ribs 1C. One or more pushing parts 4 may be fastened to a common holding part in order to push it toward the slot 2. Alternatively, the holding part 3 may be split so as to push a chosen number of the ribs 1C, or one single rib, depending on the available equipment and the present situation.

Figure 9A:
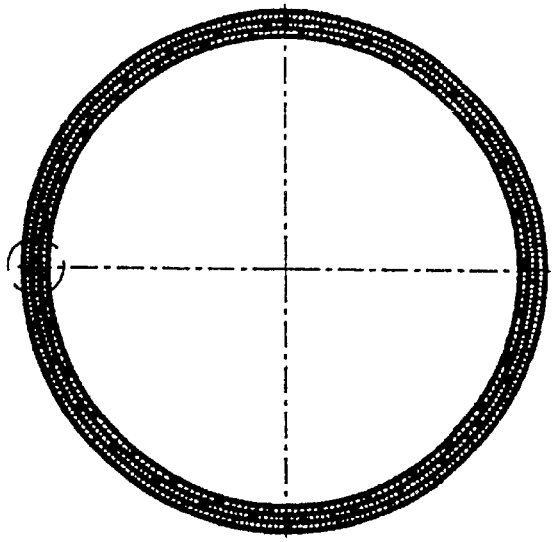
FIG. 9A illustrates an alternative embodiment of the ribs in a device according to the invention.
Figure 9B:
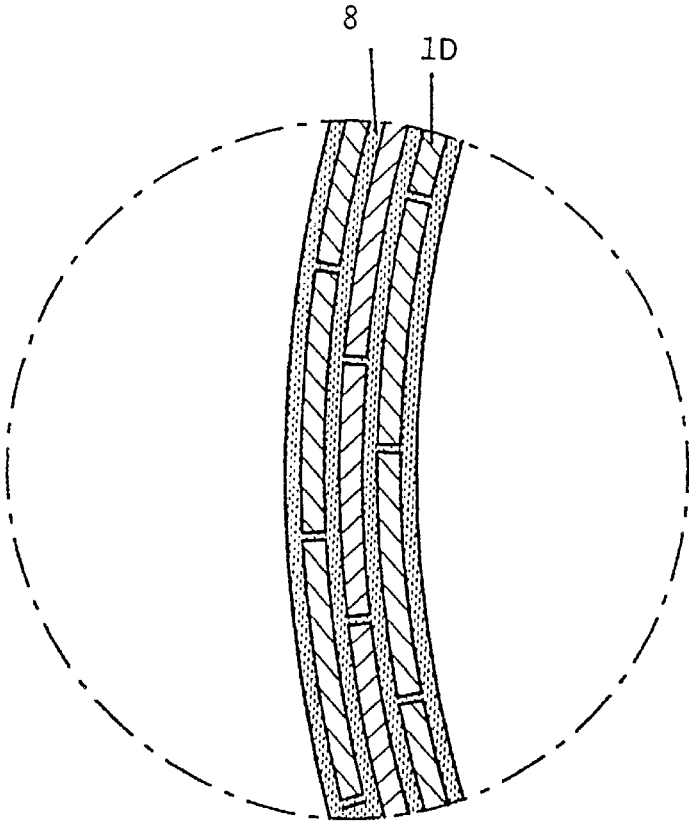
FIG. 9B shows a detail of the device shown in FIG. 9A.

FIGS. 9A and 9B show an alternative embodiment of the ribs in which the sealing crown comprises several layers of ribs 1D capable of being shifted tangentially relative to each other. When this sealing crown expands, the ribs 1D will still overlap, thus maintaining the seal. To guide the ribs 1D in this embodiment, the ribs 1D are enveloped in a very flexible material 8, e.g. a suitable type of rubber, which also will contribute to sealing between the ribs 1D. The ribs 1D in this embodiment may be wedge shaped toward the inner ends so that they may be fastened to the holding part or parts 3 in the same way as the ribs 1D described with reference to FIG. 4, so that the ribs 1D may lay side by side at the mount holding the part or parts.

What is claimed is:

1. A device for annular isolation in oil/gas wells comprising a production pipe, wherein the pipe comprises a coaxially positioned cylindrical sleeve in a first end having a slot with a first end and a second end, said slot being at least partially radially oriented at the first end, said sleeve including a cylindrical sealing crown having a first end and a second end, said sealing crown coupled in its first end to a release mechanism capable of pushing the sealing crown in the slot to extend out substantially radially from the sleeve at the second end of the sealing crown, said sealing crown at least in its second end being expandable in the tangential direction.

2. The device according to claim 1, wherein the sealing crown comprises a number of bendable, interconnected axial ribs, the coupling between the ribs at least at their second ends providing a tangential relative movement.

3. The device according to claim 1, wherein the sealing crown in its second end comprises a soft material.

4. The device according to claim 1, wherein the sealing crown is provided with one or more fastening devices cooperating with corresponding fastening devices in the sleeve when the sealing crown is pushed out of the sleeve.

5. The device according to claim 1, wherein the release mechanism comprises a preloaded spring.

6. The device according to claim 1, wherein the release mechanism comprises a hydraulic piston.

7. The device according to claim 1, further comprising a plurality of ribs and wherein the release mechanism comprises one release mechanism coupled to each of the ribs.

8. The device according to claim 1, wherein the production pipe comprises two sleeves, each comprising a sealing crown with corresponding release mechanisms, the open ends of the sleeves being turned toward each other.

9. The device according to claim 1, wherein the opening slot is connected to a passage contained within said sleeve and the sealing crown is at least partially positioned within said passage.

10. A device for annular isolation in oil/gas wells comprising a production pipe, wherein the pipe comprises a coaxially positioned cylindrical sleeve having an internal slot with a first end approximately parallel to the sleeve and a second end at least partially radially oriented and having an opening in an external surface of said sleeve, said sleeve including a cylindrical sealing crown having a first end and a second end, said sealing crown coupled in its first end to a release mechanism capable of pushing the sealing crown within the slot and out through the opening, said sealing crown at least in its second end being expandable in the tangential direction.

11. A device for annular isolation of a production pipe in oil/gas wells comprising:

a cylindrical sleeve configured to be coaxially positioned in the production pipe;

a sealing means for sealing against a surface of the oil/gas well when actuated, said sealing means being at least partially contained within the sleeve;

a slot means within the sleeve for positioning and guiding the sealing means; and a pushing means for pushing the sealing means through the slot means to actuate the sealing means, wherein the slot means is configured to direct the sealing means toward the surface of the oil/gas well when the sealing means is pushed by the pushing means.

12. A method for providing annular isolation in a well, comprising the steps:

positioning within the well a coaxially positioned cylindrical sleeve having a first end and a second end, and an at least partially radially oriented opening slot, said sleeve including a cylindrical sealing crown coupled in the first end to a release mechanism capable of pushing the sealing crown through the opening slot, said sealing crown in its second end being expandable in the tangential direction; and activating the release mechanism to push the sealing crown through the opening slot.

13. The method according to claim 12, wherein the release mechanism comprises a hydraulic piston and the step of activating the release mechanism comprises pressuring the well.

* * * * *